United States Patent [19]

Musto

[11] Patent Number: 4,478,157

[45] Date of Patent: Oct. 23, 1984

[54] MILL RECIRCULATION SYSTEM

[75] Inventor: Richard L. Musto, Homewood, Ill.

[73] Assignee: Combustion Engineering, Inc., Windsor, Conn.

[21] Appl. No.: 564,660

[22] Filed: Dec. 23, 1983

Related U.S. Application Data

[62] Division of Ser. No. 442,557, Nov. 18, 1982.

[51] Int. Cl.[3] ..... F23K 1/00

[52] U.S. Cl. ..... 110/106; 209/144; 241/56

[58] Field of Search ..... 110/106, 261–265; 209/144; 241/56

[56] References Cited

U.S. PATENT DOCUMENTS

| | | | |
|---|---|---|---|
| 1,562,411 | 11/1925 | Caracristie et al. | 110/106 |
| 1,628,609 | 5/1927 | Newhouse | 110/106 |
| 2,259,967 | 10/1941 | Vogel-Jorgensen | 110/106 |
| 2,280,238 | 4/1942 | Kanowitz | 209/144 |
| 2,418,061 | 3/1947 | Weinberger | 209/144 |
| 2,427,903 | 9/1947 | Crites | 110/106 |
| 2,494,070 | 1/1950 | Thomas | 110/106 |
| 2,561,564 | 7/1951 | Crites | 209/144 |
| 2,708,033 | 5/1955 | Thomas | 209/144 |
| 3,071,330 | 1/1963 | Jackering | 241/56 |
| 4,211,641 | 7/1980 | Jager | 209/144 |

FOREIGN PATENT DOCUMENTS

| | | | |
|---|---|---|---|
| 312707 | 6/1929 | United Kingdom | 110/106 |

*Primary Examiner*—Henry C. Yuen

*Attorney, Agent, or Firm*—Arthur E. Fournier, Jr.

[57] ABSTRACT

A mill recirculation system (10, 40) that is operative for purposes of effecting the pulverization and firing of solid fuels, while yet possessing all of the desirable features of a direct fired system. The subject system (10, 40) includes pulverizer means (14, 48), classifier means (12, 44) and burner means (16, 68) as well as a preestablished fluid flow path by which the pulverizer means (14, 48) and the classifier means (12, 44) are interconnected in fluid flow relation with the burner means (16, 68). In accord with the mode of operation of the subject mill recirculation system (10, 40) a stream of solid fuel is made to flow along the fluid flow path such that the solid fuel is pulverized in the pulverizer means (14, 48), classified according to particle size in the classifier means (12, 44) and fired in the burner means (16, 68). Further, a stream of a suitable gaseous medium is made to flow along the flow path such that the gaseous medium is operative to cause the solid fuel to be conveyed therewith through the pulverizer means (14, 48) while being dried thereby and to be conveyed therewith from the pulverizer means (14, 48) to the classifier means (12, 44). At the classifier means (12, 44) a separation is had of the stream of the gaseous medium such that a portion of the gaseous medium is recirculated along with the oversize solid fuel particles back to the pulverizer means (14, 48) while the remainder of the gaseous medium is operative to convey the solid fuel particles that are of the desired size from the classifier means (12, 44) to the burner means (16, 68) for burning, i.e., firing, in the latter.

6 Claims, 3 Drawing Figures

MILL RECIRCULATION SYSTEM

This is a division, of application Ser. No. 442,557 filed Nov. 18, 1982.

BACKGROUND OF THE INVENTION

This invention relates to pulverizing and firing systems for solid fuels, and in particular to a mill recirculation system which while being operative for purposes of effecting the pulverization and subsequent firing of solid fuels in any form of structure that embodies a suitable type of combustion chamber, e.g., boilers, kilns, furnaces, air heaters, etc. is imbued with those features that serve to desirably characterize a direct fired system.

There are three basic types of solid fuel pulverizer firing systems in use today. These are the direct-fired system, the semi-direct fired system and the bin storage system. The simplest and most commonly used of these three systems is the direct-fired system. The nature of this latter system is such that solid fuel, e.g., wet coal, is fed in a suitable manner along with hot gases to a pulverizer. The solid fuel is simultaneously ground and dried within the pulverizer. The drying of the solid fuel is effected by the hot gases as the latter sweep through the pulverizer. The pulverizer that is utilized to accomplish the above may take the form of a hammermill, a ring-roll mill or a ball mill. As the hot gases sweep through the pulverizer they are cooled and humidified by means of the evaporation of the moisture contained in the solid fuel. Normally, a fan is utilized for purposes of removing the hot gases and the entrained fine solid fuel particles from the pulverizer. Moreover, usually this fan is located on the discharge side of the pulverizer and is operative to effect the delivery of the mixture of hot gases and entrained fine solid fuel particles to a burner.

The main advantages of the direct-fired system are simplicity, low cost and maximum safety. The potentially hazardous fine solid fuel particles go directly to the burner at high velocities, and thus are not given the opportunity to collect and possibly ignite spontaneously. Accordingly, the direct-fired system can be operated at the maximum temperatures that safety will allow. Further, in those instances wherein the pulverization of the solid fuel is effected by means of hammermills or ring-roll mills there is very little solid fuel present in the system at any given time. Therefore, should a fire occur in the system, it will be of relatively small size and as such is capable of being readily extinguished.

However, there is one major disadvantage associated with the employment of a direct-fired system. This consists of the fact that all of the hot gas, e.g., air, that is required for purposes of drying the solid fuel particles plus the air that infiltrates the pulverizer becomes primary air for the burner. Therefore, in those instances wherein the solid fuel particles are very wet more air is required for drying. Accordingly, the quantity of primary air thus forms a large percentage of the air which is required to support combustion. Further, in the case of pulverizers that take the form of hammermills and ring-roll mills, the amount of air that is required to flow therethrough in order for the pulverizer to operate at maximum capacity may be in excess of that required to dry the solid fuel particles. Lastly, the air which leaves the pulverizer is usually low in temperature and high in moisture. Unfortunately, though, the thermal efficiency of the burner is adversely affected when air that is low in temperature and/or high in moisture is utilized to support combustion in the burner.

Thus, to recapitulate, the mode of operation of a direct-fired system is such that all of the hot gas which is required to dry the solid fuel particles as well as that which is required to sweep the pulverizer for purposes of effecting the transport therethrough of the solid fuel particles operates also to effect the conveyance of the pulverized solid fuel to the combustion chamber of the burner wherein the solid fuel is fired. Moreover, since the conveying medium is usually air, the latter becomes part of the combustion air that is required to effect the burning, i.e., firing, of the solid fuel. Unfortunately, the hot gas, e.g., air, required to satisfy the drying, grinding, classifying requirements imposed thereupon by virtue of the nature of the operation of the pulverizer constitutes a relatively large quantity thereof and also is at a relatively low temperature. Both of these factors render the hot gas that flows through the pulverizer undesirable for use as combustion air in the burner. On the other hand, in most applications wherein a pulverizer is employed in conjunction with a burner to supply pulverized solid fuel thereto, there is an adequate amount of hot combustion air available, which has been recuperated from the exhaust gases of the system through the use of heat exchangers. Consequently, by utilizing the hot combustion air that has been recuperated from the exhaust gases of the system in lieu of the hot air that flows through the pulverizer, it is possible to improve the thermal efficiencies of the system and concomitantly thereby reduce the fuel consumption requirements thereof.

Turning next to a consideration of the second of the three types of firing systems referred to hereinbefore, i.e., that of the semi-direct fired system, the development thereof was occasioned principally by the desire to overcome the disadvantage of the direct-fired system which has been discussed above, while yet providing a system that would maintain the desirable safety and low cost features which are characteristic of a direct-fired system. Thus, in accord with the mode of operation of the aforesaid semi-direct fired system, the mixture of pulverized solid fuel particles and spent drying gases is conveyed through the action of a system fan to a cyclone collector whereat a separation thereof is effected. Namely, a portion of the spent drying gases is circulated from the cyclone collector back to the pulverizer whereat the recirculated spent drying gases are reheated by virtue of being mixed with high temperature fresh hot gases with which the pulverizer is being fed. The remainder of the spent drying gases that are received at the cyclone collector are vented. Desirably, the portion of the spent drying gases that is vented equals the weight of the fresh hot gases fed to the pulverizer, the amount of air that leaks into the pulverizer, and the water that is evaporated. Generally, under most conditions, the quantity of spent drying gases that is vented is considerably less than the total quantity that is required to flow through the pulverizer for purposes of effecting the efficient operation of the latter.

Continuing, the quantity of spent drying gases that is vented is then directed to the solids discharge area of the cyclone collector whereat the vented gases pick up the pulverized solid fuel particles and function to convey the latter in the form of a mixture of pulverized solid fuel particles and vented gases having a very high fuel to air ratio to the combustion chamber of the burner. The conveying vented gases, e.g., air, then become a very small percentage of the total amount of combustion air that is required to effect the firing of the pulverized solid fuel particles in the burner. The additional air necessary to support combustion is then introduced into the burner from the recuperator. That is, this additional air constitutes hot air which has been recuperated from the system's exhaust gases.

Finally, the remaining one of the three types of firing systems that has yet to be discussed herein is that of the bin storage system. In accord therewith, the hot gas flow circuit associated with the functioning of the pulverizer is totally divorced of the hot gas flow which the burner receives. More specifically, the mode of operation of the bin storage system is such that the mixture of pulverized solid fuel particles and spent drying gases is conveyed to a cyclone collector whereat the pulverized fuel particles are discharged into a storage bin and the drying gases are vented to a secondary collector and thence to the atmosphere. As required, quantities of pulverized solid fuel particles are removed from the storage bin along with a relatively small quantity of conveying air thereby maximizing the amount of heated recuperated air which can be employed as combustion air for purposes of firing the pulverized solid fuel particles in the burner. Accordingly, the bin storage system provides the highest thermal efficiency of the three firing systems that have been discussed herein, i.e., the direct-fired system, the semi-direct fired system and the bin storage system.

Insofar as a comparison of the three above-described firing systems is concerned, the increase in thermal efficiency which is achieved with the semi-direct fired system and the bin storage system is obtainable only at the expense of providing a system that has less desirable operating features and which is more complex. By way of exemplification in this regard, note is taken of the fact that pulverized solid fuel particles can pose a potential hazard insofar as the handling and storage thereof is concerned. Moreover, pulverized solid fuel particles are known to be susceptible to igniting spontaneously.

On the other hand, the main advantages of the direct-fired system are its simplicity, low cost, and safe mode of operation. These advantages stem principally from the fact that in accord with the mode of operation of the direct-fired system the potentially hazardous pulverized solid fuel particles are conveyed directly to the combustion chamber of the burner at relatively high velocities whereat they are fired. Consequently, problems associated with the handling and storage of the pulverized fuel particles are avoided. Likewise, with such a mode of operation there is no opportunity for the pulverized fuel particles to collect and subsequently spontaneously ignite.

As regards the semi-direct fired system, the latter has a less desirable mode of operation when compared to the aforereferenced direct-fired system in that the pulverized solid fuel particles upon entering the cyclone collector pass through both limits of the explosive range thereof as the hot gases are being separated therefrom. Therefore, the pulverized fuel particles become very sensitive to temperature and are susceptible to being ignited upon being exposed to system vent temperatures of a relatively high nature. Additionally, in the semi-direct fired system the cyclone collector is usually operated at a relatively high negative pressure whereas the line located therebeneath through which the pulverized solid fuel particles upon being discharged from the cyclone collector are conveyed to the combustor is usually at a very high positive pressure. Consequently, the valve which is utilized to discharge the pulverized fuel particles from the cyclone collector into the aforementioned conveying line operates at an extremely high differential temperature which produces rapid wearing of the valve. This wearing of the valve in turn gives rise to the occurrence of subsequent leakage of the conveying gas from the line into the cyclone collector. Furthermore, such leakage has an adverse effect on the operating efficiency of the cyclone collector and also can occasion a condition wherein a mixture of solid fuel particles and hot gases, which is of an explosive nature, is caused to be recycled back to the pulverizer.

When compared to the other two forms of firing systems and most particularly to the direct-fired system, the bin storage system is disadvantageously characterized in at least two significant respects. First, by virtue of the nature of the mode of operation of the bin storage system there exists a requirement that pulverized fuel particles be stored in a storage bin. It is a known fact, however, that pulverized solid fuel particles when stored can spontaneously ignite. Moreover, should such spontaneous ignition of the particles occur, the extinguishment and the removal of the ignited particles from the storage bin could be expected to present a problem. Thus, in an effort to minimize the extent of this problem, storage bins for storing such pulverized fuel particles have heretofore been sealed and pressurized with inert gas. Unfortunately, however, to do this is rather costly.

With further reference to the matter of the storage bin, ensuring that pulverized fuel particles are discharged therefrom at a uniform control rate can necessitate the employment in cooperative association with the storage bin of some type of means which is undesirably characterized both in terms of its complex construction and the fact that it is costly to provide. By way of exemplification in this regard, reference is had here to the fact that some forms of pulverized solid fuels such as pulverized coal have flow characteristics that are much like those of water whereas other forms of pulverized solid fuels such as pulverized bark and wood have a tendency to collect and effect a bridging of the discharge outlet of the storage bin thereby requiring the utilization of a further means that has the operative capability to negate this tendency of the pulverized fuel to collect and effect the bridging of the discharge outlet of the storage bin.

The second notable disadvantage of the bin storage system involves the gaseous discharge that occurs therefrom to the atmosphere. Namely, since cyclone collectors are known to be less than one hundred percent efficient in removing all of the particulate matter from the mixture of solid fuel particles and conveying gases that is received thereby, particulate matter is emitted along with the gas that is exhausted therefrom to the atmosphere. Further, it is possible that the extent of such particulate matter emission may be such as to run afoul of the air pollution requirements that are in effect in the jurisdiction in which the bin storage system is being employed. In addition, in those instances wherein a high pressure drop wet scrubber is utilized for purposes of effecting the removal of particulate matter from the gas stream, a further problem may be posed. More specifically, the nature of the mode of operation of a high pressure drop wet scrubber is such that relatively large quantities of water are required to accomplish the removal of the particulate matter to the extent desired. However, the need for such large quantities of water creates a disposal problem of its own since the water effluent from the scrubber may contain up to one to two percent of pulverized solid fuel particles. Usually, these solid fuel particles are required to be removed from the water effluent before the latter can be discharged into a local sewage system.

Accordingly, the type of secondary collector which is most commonly used with a bin storage system is that of a cloth bag dust collector. The latter which is often referred to as a "baghouse", operates to effectively recover the particulate matter which is contained in the gases that are to be vented from the system to the atmosphere, as well as to effect the return of the recovered particulate matter to a suitable location. However, there are hazards associated with the use of a cloth bag dust collector to recover particulate matter from vent gases that are at relatively high temperatures. Namely, the particulate matter which enters the dust collector is of an extremely fine nature and thus can very easily spontaneously ignite if the particulate matter is not kept in a constant state of motion. Small upward excursions in the temperature of the gases that contain the particulate matter, which is sought to be recovered through the use of the dust collector, can be sufficient to cause the particulate matter to spontaneously ignite.

A need has thus been evidenced for a new and improved firing system that would be advantageously characterized by the fact that the mode of operation thereof enables a more desirable fuel/air ratio to be established at the burner, while yet providing a firing system which retains the advantages of a direct-fired system insofar as simplicity, low cost and safety are concerned. More specifically, such a new and improved firing system has been sought wherein the more desirable fuel/air ratio that is established thereby at the burner is accomplished as a consequence of causing the recirculation back to the pulverizer of a portion of the gases leaving the classifier.

It is, therefore, an object of the present invention to provide a new and improved form of firing system of the type that is operative for purposes of effecting the pulverization of solid fuels followed by the firing thereof.

It is another object of the present invention to provide such a firing system which is in the nature of a direct fired system.

It is still another object of the present invention to provide such a direct fired system which possesses the advantages of a direct fired system insofar as simplicity, low cost and safety are concerned.

A further object of the present invention is to provide such a direct fired system which is further advantageously characterized by the fact that in accord with the mode of operation thereof a more desirable fuel/air ratio is established at the burner.

A still further object of the present invention is to provide such a direct fired system wherein the establishment of a more desirable fuel/air ratio at the burner is accomplished as a consequence of causing the recirculation back to the pulverizer of a portion of the gases that exit from the classifier and without requiring the use within the system of a cyclone collector or a discharge valve.

SUMMARY OF THE INVENTION

In accord with the present invention there is provided a new and improved form of direct fired system operative for purposes of effecting the pulverization and subsequent firing of solid fuels. The subject system includes pulverizing means, classifier means and burner means as well as a preestablished fluid flow path by which the pulverizer means and the classifier means are interconnected in fluid flow relation with the burner means. In accord with one embodiment of the invention, the classifier means comprises a mechanical separator to which the solid fuel after being pulverized in the pulverizer means is suitably conveyed such that the pulverized solid fuel particles are caused to be introduced thereinto through the bottom inlet with which the mechanical separator is suitably provided. As the solid fuel particles flow in an upwardly direction through the mechanical separator a separation is had of the fines from the larger solid particles. This separation is accomplished as a result of the influence thereon of centrifugal force acting in consort with the velocity of the gases in which the solid fuel particles are entrained. The result is that the larger solid fuel particles along with a portion of the aforementioned gases are caused to flow to and through a first outlet with which the mechanical separator is suitably provided from whence the mixture of larger particles and gases is caused to be recirculated back to the pulverizer means. While the fines and the remainder of the gases, on the other hand, flow to and through a second outlet with which the mechanical separator is suitably provided and are caused to flow to the burner means whereat the fines are burned.

In accord with a second embodiment of the invention, the classifier means of the subject system comprises a classifying elbow. The latter elbow is suitably formed as part of a length of duct through which the pulverized solid fuel particles upon leaving the pulverizer means are made to flow. More specifically, the classifying elbow comprises a bifurcated section of duct with which a deflector blade means is cooperatively associated. The deflector blade means is mounted relative to the bifurcated section of duct such as to be moveable in each of two planes with respect thereto. Moreover, by varying the position of the deflector blade means relative to the path of flow of the solid fuel particles control is established over the degree of fineness of particle separation which takes place as the solid fuel particles pass through the classifying elbow. Namely, the larger particles along with a portion of the gases in which the pulverized solid fuel particles are entrained as the latter reach the classifying elbow pass through one of the bifurcations of the classifying elbow and are caused to be recirculated back to the pulverizer means. The smaller solid fuel particles, on the other hand, along with the remainder of the gases flow through the other bifurcation of the classifying elbow and are caused to flow to the burner means in which the smaller solid fuel particles are burned.

DESCRIPTION OF A PREFERRED EMBODIMENT

Figure 1:
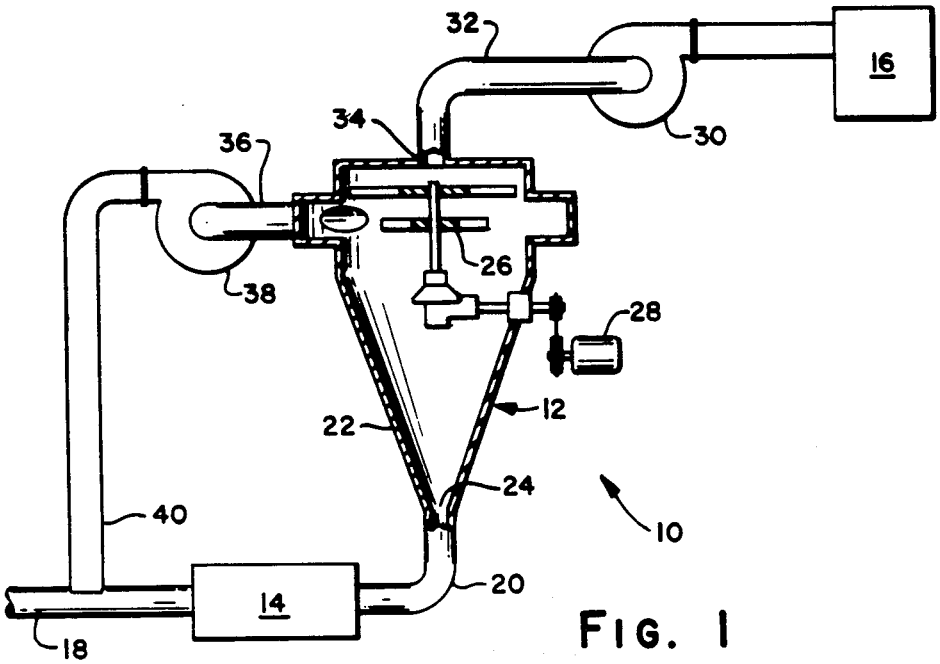
FIG. 1 is a schematic illustration of one embodiment of a direct fired system including pulverizer means, classifying means and burner means, and characterized in that the classifier means comprises a mechanical separator, constructed in accordance with the present invention.

Referring now to the drawing, and in particular to FIG. 1 thereof, there is illustrated therein a direct fired system, generally designated by the reference numeral 10, constructed in accordance with the present invention. More specifically, there is depicted in FIG. 1 a direct fired system 10 that includes a classifier means, generally designated by the reference numeral 12, which is cooperatively associated in a manner to which further reference will be had hereinafter to a pulverizer means 14. In addition, both the classifier means 12 and the pulverizer 14 are connected in fluid flow relation to a burner means that is generally designated in FIG. 1 by the reference numeral 16.

Continuing with the description of the direct fired system 10 of FIG. 1, the latter is designed to be operative for purposes of effecting the pulverization and the subsequent firing of solid fuels. To this end, the mode of operation of the direct fired system 10 of FIG. 1, simply stated, is such that solid fuel in suitable quantity is fed to the pulverizer means 14 whereat the solid fuel is ground and dried. Thereafter, the pulverized and dried solid fuel particles are caused to be conveyed to the classifier means 12 wherein the solid fuel particles are classified according to fineness, and those that are found to be oversize are rejected and returned to the pulverizer means 14 for further grinding. Those solid fuel particles though that meet the preestablished specifications for fineness are caused to be conveyed to the burner means 16 and are fired therein.

In accord with the teachings of the present invention, the pulverizer means 14 may take the form of any suitable conventional form of pulverizing device that is commonly found utilized for purposes of effecting the pulverization, i.e., grinding, of solid materials of the type that are capable of being burned as solid fuels. By way of exemplification in this regard, reference is had here to such pulverizing devices as hammermills, ring-roll mills, ball mills, etc. Since the nature of the construction as well as the mode of operation of such mills is well-known to those skilled in the art of the pulverization of materials, it is not deemed necessary to set forth a detailed description thereof herein or to include an illustration thereof in the drawing. Rather, it is deemed sufficient for purposes of obtaining an understanding of the subject matter of the present invention to simply note herein that the function of the pulverizer means 14 is to effect a pulverization and drying of solid fuel materials therewithin. For this purpose, solid fuel in the required quantity and at the required rate is supplied from a suitable source of supply thereof (not shown) to the pulverizer means 14 by any suitable form of transport means, the latter being operative to effect an interconnection of the solid fuel supply source (not shown) with the pulverizer means 14, e.g., conduit means (not shown), etc.

The drying of the solid fuel particles, as well as the conveyance thereof through the pulverizer means 14 is accomplished in known fashion by means of a hot gas flow which is made to sweep through the interior of the pulverizer means 14. This hot gas, which preferably consists of air, is supplied through any suitable conventional means to the pulverizer means 14. In accord with the illustration of FIG. 1 of the drawing, the aforesaid hot gas is fed to the pulverizer means 14 through the conduit means, which is identified in FIG. 1 by the reference numeral 18.

After leaving the pulverizer means 14, the stream of solid fuel particles flows upwardly through duct 20 in the gas stream and enters the classifier means 12. More specifically, in accord with the embodiment of the invention that is depicted in FIG. 1 of the drawing, the classifier means 12 comprises a mechanical separator of the type known to those skilled in the art as a whizzer separator. With further reference to FIG. 1, from duct, i.e., conduit, 20 the stream of pulverized solid fuel particles enters the whizzer separator housing 22 through the bottom inlet 24, which is provided therein for this purpose. The pulverized solid fuel particles are then carried, in known fashion, upwardly through the whizzer separator housing 22 into the path of rotation of the whizzer blades 26. Rotation is imparted to the blades 26 by means of the motor 28.

The larger solid fuel particles are contacted by the whizzer blades 26 with the result that the larger particles are subjected to centrifugal force. Further, as a consequence the larger particles are flung outwardly into contact with the inner surface of the side walls of the whizzer separator housing 22. The fines, i.e., the smaller solid fuel particles, are so small that even though they are struck by the whizzer blades 26, the centrifugal force imparted to them is not sufficient enough to overcome the velocity force created by the fan 30 which is suitably associated with the duct, i.e., conduit 32. Thus, the fines, i.e., the solid fuel particles that are of a preestablished desired size or smaller, leave the whizzer separator housing 22 through an upper outlet suitably formed for this purpose therein and denoted in FIG. 1 by the reference numeral 34.

The larger solid fuel particles, on the other hand, in their circular flow path along the inner surface of the side walls of the whizzer separator housing 22, encounter a tangential outlet opening, suitably formed for this purpose therein, and pass therethrough. The latter tangential outlet opening in known fashion is cooperatively associated with the duct, i.e., conduit, 36 whereby the larger solid fuel particles after passing through the aforesaid tangential outlet opening enter the duct 36. For a purpose now to be described, the duct 36 has a fan 38 suitably associated therewith. That is, to assist in the separation within the whizzer separator housing 22 of the larger solid fuel particles from the fines, a slight suction is created by fan 38. Thus, the centrifugal force imparted to the larger solid fuel particles by the rotation whizzer blades 26, in conjunction with the suction created by fan 38, cause some of the gases and the larger, more coarse solid fuel particles to flow into the duct 36. Normally, the suction created by the fan 30 will be greater than that created by the fan 38, or else substantially all of the solid fuel particles would flow into duct 36. It should be apparent, however, that the degree of fineness of the particles flowing to duct 32 can be varied by varying the relative gas flows created by the two fans 30 and 38. The speed of rotation, and number of whizzer blades 26, also affect the classification of the solid fuel particles. That is, the more blades 26 and higher revolutions per minutes (RPM) thereof creates a stronger centrifugal force, and thus more solids will be separated out through the duct 36.

The third major operating component of the direct fired system depicted in FIG. 1 is the burner means 16. The latter is the device in which the pulverized solid fuel particles after having been classified in the classifier means 12 and found to possess the desired fineness are fired, i.e., burned. For purposes of effecting the burning of the properly sized solid fuel particles, the burner means 16 in accord with the teachings of the present invention may comprise any form of structure which embodies a suitable type of combustion chamber. Accordingly, by way of exemplification and not limitation, the burner means 16 may take the form of any of the following: a boiler, a kiln, a furnace, or an air heater.

With further reference to FIG. 1, the pulverized solid fuel particles which in passing through the classifier means 12 have been found to possess the desired degree of fineness are preferably caused to be conveyed from the classifier means 12 to the burner means 16 through the action of the fan that is denoted in FIG. 1 by the reference numeral 30. For purposes of effecting the aforedescribed conveyance of the pulverized solid fuel particles from the classifier means 12 to the burner means 16, in accord with the teachings of the present invention any suitable type of fan of conventional construction, which has the capability of functioning in the aforesaid manner, is capable of being utilized in the direct fired system 10 of FIG. 1.

Completing the description of the structure which is schematically depicted in FIG. 1, a portion of the gas flow through the classifier means 12 is recovered and returned to the pulverizer means 14. This recirculation of a portion of the gas flow from the classifier means 12 to the pulverizer means 14 is shown schematically in FIG. 1 by that structure depicted therein that is identified generally by the reference numeral 40.

A description will now be had of the mode of operation of the direct fired system 10 constructed as illustrated in FIG. 1 and as described hereinbefore. The pulverized solid fuel particles flow from the pulverizer means 14 entrained in a stream of hot gases, which in accord with the preferred embodiment of the invention comprises air. For this purpose, the classifier means 12 is suitably interconnected in fluid flow relation with the aforesaid pulverizer means 14 by means of conduit, i.e., duct means 20 which embodies a conventional form of construction. After entering the classifier means 12, i.e., whizzer separator housing 22, from the conduit means 20, those solid fuel particles which do not meet the preset specification for fineness are rejected, i.e., separated from the stream of air in which they are entrained. This separation of the oversize particles is effected within the whizzer separator housing 22 as has been described previously hereinabove.

Continuing, the oversize particles are then returned for further grinding to the grinding chamber of the pulverizer means 14. For this purpose the oversize particles are made to flow from the whizzer separator housing 22 into the duct 36, which is suitably associated with the former. The fan 38 is suitably connected in fluid flow relation with the duct 36 and therethrough to the whizzer separator housing 22. As such, through the action of the fan 38 the oversize particles, i.e., the tailings, that do not meet the preset specification for fineness of the classifier means 12 are caused to return, i.e., flow back, to the grinding chamber of the pulverizer means 14 for further grinding therewithin. In addition, however, and most importantly from the standpoint of the novelty of the present invention, the fan 38 is also intended to be operative such that a portion of the stream of air that flows through the classifier means 12 is also made to return to the pulverizer means 14. Namely, the fan 38 functions not only to cause the oversize particles that are discharged from the classifier means 12 and flow through the duct 36 to be returned back through the conduit means 40 to the pulverizer means 14 for further grinding therein, but also functions to return with the oversize particles much of the air that would normally flow from the classifier means 12 to the burner means 16 with which the classifier means 12 is cooperatively associated as best understood with reference to FIG. 1 of the drawing.

The effect of this recirculation of a portion of the air flow through the action of the fan 38 from the classifier means 12 to the pulverizer means 14 is to reduce the amount of air that leaves the classifier means 12 through the conduit, i.e., duct, that is denoted in FIG. 1 by means of the reference numeral 32. As shown in FIG. 1, the conduit 32 is suitably connected in fluid flow relation with the fan 30 and therethrough to a suitable burner means 16. The latter is designed to be operative to effect a burning, i.e., firing, therewithin of the solid fuel particles that have been determined through the operation of the classifier means 12 to possess the desired degree of fineness.

To summarize, if the air flow in which solid fuel particles are entrained from the pulverizer means 14 is a predetermined amount, then the fan 38 is designed to effect a recirculation from the classifier means 12 to the pulverizer means 14 of a certain portion of this predetermined amount of air flow. The remaining portion of the air flow which enters the classifier means 12 through the conduit 20, on the other hand, flows from the classifier means 12 through the conduit 32 to the burner means 16 along with those solid fuel particles which are of the desired size, i.e., the fines. The fines are in turn burned, i.e., fired, in the burner means 16 and the air that flows therewith to the burner means 16 comprises a portion of the combustion air that is required in order to effect the firing of the fines.

Figure 2:
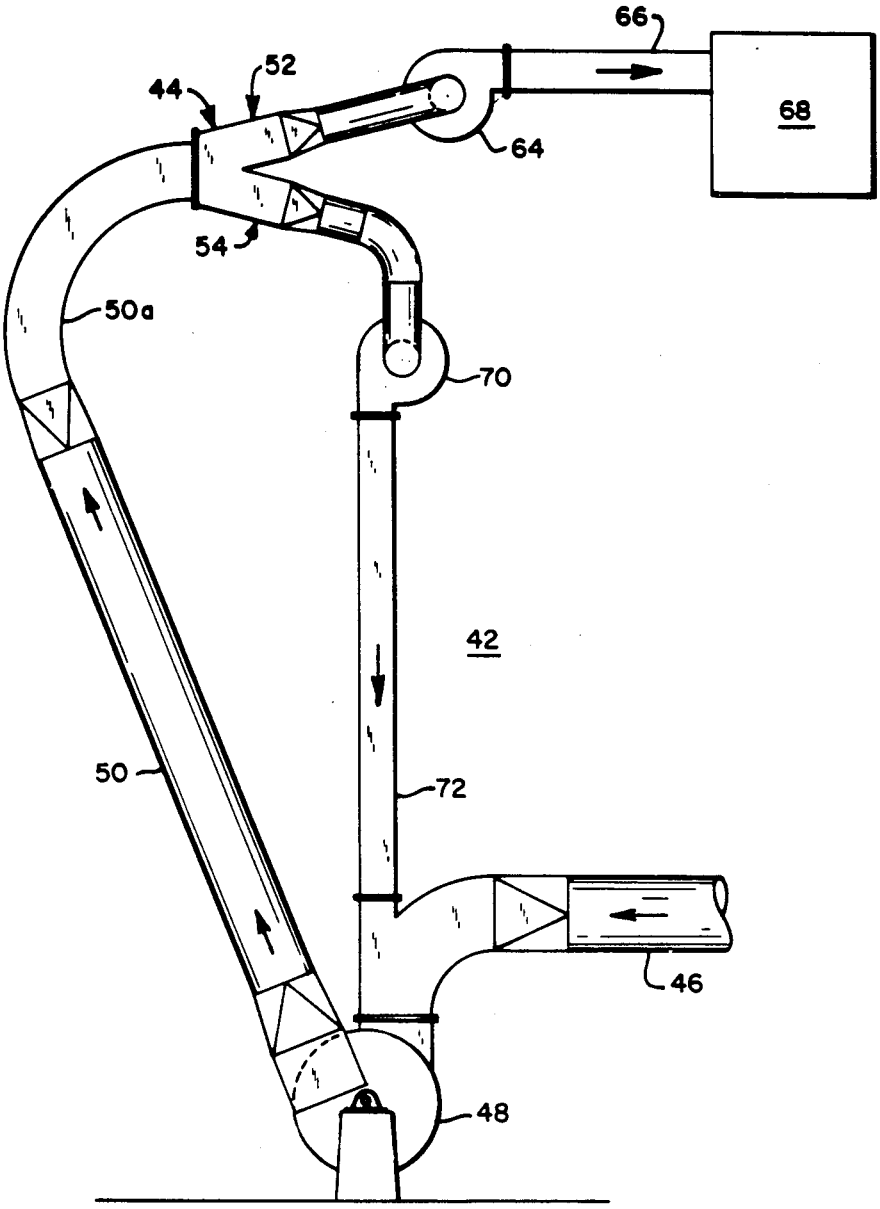
FIG. 2 is a schematic illustration of a second embodiment of a direct fired system including pulverizer means, classifier means and burner means, and characterized in that the classifier means comprises a classifying elbow, constructed in accordance with the present invention.

Turning next to a consideration of FIG. 2 of the drawing, there is schematically depicted therein a second embodiment of a direct fired system constructed in accordance with the present invention, generally designated in FIG. 2 by the reference numeral 42. The principal difference between the direct fired system 10 of FIG. 1 and the direct fired system 42 of FIG. 2 resides in the fact that the classifier means 44 as illustrated in the latter Figure comprises a classifying elbow whereas the classifier means 12 of the direct fired system 10 of FIG. 1 comprises a whizzer separator.

With further reference to FIG. 2, there is illustrated therein a direct fired system denoted generally by the reference numeral 42, which like the direct fired system 10 of FIG. 1 is operative to effect the pulverization followed by the subsequent firing of solid fuel particles. Moreover, in the manner of the direct fired system 10 of FIG. 1, solid fuel in suitable quantity and at a suitable rate is conveyed from a suitable source of supply thereof (not shown) through the conduit means 46 to the pulverizer means 48. The pulverizer means 48 is operative to effect the pulverization and drying of the solid fuel material that is conveyed thereto. The solid fuel particles after being pulverized and dried within the pulverizer means 48 flow by means of conduit, i.e., duct, 50 to the classifier means 44 whereat the oversize particles, in a manner which will be more fully described hereinafter, are rejected thereby and are returned to the grinding chamber of the pulverizer means 48 for further grinding. As in the case of the pulverizer means 14 of FIG. 1, the drying of the solid fuel particles in the pulverizer means 48 is accomplished by having a stream of hot gases, preferably air, sweep therethrough. Not only does this stream of hot gases effect the drying of the solid fuel particles, but also it is operative to effect the conveyance of the solid fuel particles in known manner to, through, and from the grinding chamber of the pulverizer means 48 to and through classifier means 44.

Figure 3:
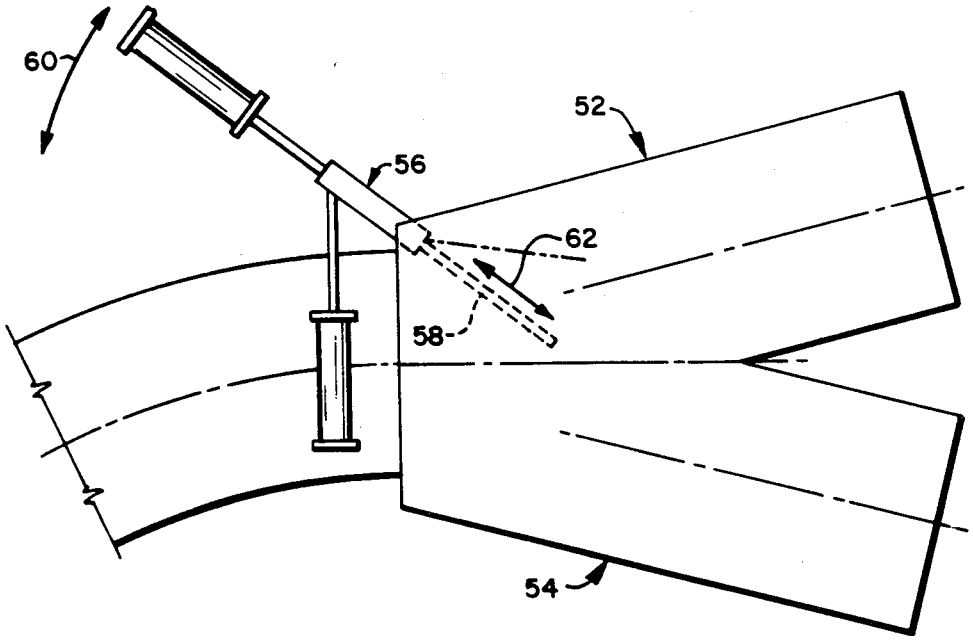
FIG. 3 is a side elevational view on an enlarged scale and with parts broken away of the classifying elbow of the direct fired system of FIG. 2, constructed in accordance with the present invention.

As best understood with reference to FIG. 3 of the drawing the classifier means 44 comprises a classifying elbow suitably positioned relative to the downstream end, i.e., bend section, 50*a* of the conduit 50 such as to be in fluid flow relation therewith whereby the pulverized and dried solid fuel particles after being discharged from the pulverizer means 48 flow thereto and, in a manner yet to be described, therethrough. To this end, the classifying elbow includes a section of duct composed of the bifurcations, denoted generally in FIGS. 2 and 3 by the reference numerals 52 and 54, and a deflector blade means, generally designated by the reference numeral 56, that is cooperatively associated with the bifurcations 52 and 54.

More specifically, the deflector blade means 56 is adapted to be adjustably positioned within the duct section that comprises the classifying elbow and operates to deflect the solid fuel particles flowing therethrough as hereinafter explained. Namely, the deflector blade 58 of the deflector blade means 56 not only moves up or down, as denoted by the two-headed arrow that is identified in FIG. 3 by the reference numeral 60, to control the split of the flow of the solid fuel particles to the two bifurcations 52 and 54, but also moves in or out, as denoted by the two-headed arrow that is identified by the reference numeral 62 in FIG. 3, to effect better control over the degree of fineness of the separated particles. That is, withdrawing the blade 58 relative to the interior of the bifurcated section of duct lowers the velocity in the separating zone and causes a finer product, i.e., finer particles to be produced. On the other hand, insertion of the blade 58 further into the interior of the bifurcated section of duct increases the velocity of the gas flow through the separating zone and causes a coarser product to be produced. Moreover, the limits of fineness obtained by varying the length of the blade 58 that protrudes into the bifurcated section of duct can be extended by raising or lowering the blade 58 about its pivot point. In this context, lowering the blade 58 provides the finest product and as will be discussed more fully hereinafter increases the amount of solid fuel particles that are recirculated to the pulverizer means 48. While, raising the blade 58 produces a coarser product and decreases the amount of solid fuel particles that are recirculated to the pulverizing means 48 such that the amount of recirculated solid fuel particles can even approach zero.

The operation of the classifying elbow that comprises the classifier means 44 of the direct fired system 40 of the present invention constructed in accordance with the illustrations of FIGS. 2 and 3 of the drawing is as follows. When they leave the pulverizer means 48, the fine and coarse solid fuel particles are disposed in a random orientation with respect to one another. However, as the mixture of solid fuel particles passes through the bend section 50*a* of the duct 50 all of the particles are caused to migrate under the influence of centrifugal forces generally therein toward the radially outer boundary of the bend section 50*a* with the coarser particles comprising the boundary layer and the finer particles tending to occupy the region radially inwardly therefrom. The gaseous fluid, being the least dense element and, therefore, least affected by centrifugal forces undergoes no appreciable radial migration.

Upon exiting the bend section 50*a*, the solid fuel particles entrained in a stream of hot gases enter the classifying elbow. Depending upon the positioning of the deflector blade 58 within the bifurcated section of duct a certain velocity will exist through the separating zone of the classifying elbow. Moreover, as described previously herein the degree of fineness separation of the solid fuel particles which takes place within the separating zone of the classifying elbow is a function of the velocity through the separating zone. That is, the lower the velocity through the separating zone of the classifying elbow the finer will be the particles that flow through the bifurcation 52 and the greater will be the amount of particles that flow through the bifurcation 54. Conversely, the greater the velocity through the separating zone of the classifying elbow the coarser will be the particles that flow through the bifurcation 52 and the lesser will be the amount of particles that flow through the bifurcation 54. These velocities can be controlled by varying the relative gas flows created by the two fans 64 and 70.

A description will now be had of the mode of operation of the direct fired system 40 of the present invention constructed as illustrated in FIGS. 2 and 3 of the drawing and as described hereinbefore. The classifier means 44 is connected at one end thereof to the conduit 50 through which the stream of hot gases, the latter preferably comprising air, in which the solid fuel particles pulverized in the pulverizer means 48 are entrained, flow from the pulverizer means 48 to the classifier means 44. After entering the classifier means 44, the classifying elbow thereof in the manner described above functions to cause the oversize pulverized solid fuel particles to flow into the bifurcation 54 whereas those solid fuel particles that are of the desired fineness exit from the classifying elbow through the bifurcation 52. Under the influence of the primary air fan 64 the pulverized particles that are of the desired fineness along with a portion of the air that flows to the classifying elbow from the pulverizer means 48 are made to flow through the conduit, i.e., duct, 66 to the burner means 68. There the particles are burned, i.e., fired, within the combustion chamber (not shown) of the burner means 68 while the air that flows thereto is utilized as part of the combustion air that is required to effect the firing of the particles in the burner means 68. On the other hand, under the influence of the fan identified in FIG. 2 by the reference numeral 70 the oversize particles are recirculated from the bifurcation 54 through the conduit, i.e., duct, 72 to the pulverizer means 48. Along with the oversize particles the remaining portion of the air that reaches the classifier means 44 from the pulverizer means 48 is recirculated back to the latter through the conduit 72. It can be seen from the above that in accord with the teachings of the subject matter of the present invention and as exemplified by the structure that is shown in FIGS. 2 and 3 of the drawing, a reduced flow of air is provided from the classifier means 44 to the burner means 68, which in turn results in the establishment of a more desirable fuel/air ratio in the burner means 68.

The continued escalation of fuel prices gives increased significance to the achievement of the aforementioned improvement in the thermal efficiencies of a fired system that yet retains the advantages of a direct fired system. Namely, as a consequence of the escalation of fuel prices, the consumption of poorer grades of coal along with other biomass fuels is increasing. These latter solid fuels have low grindability so that for any given size pulverizer, the capability therewith to effect pulverization of these fuels is significantly reduced. Moreover, since the air flow through the pulverizer required for the operation thereof normally cannot be reduced in proportion to reductions in capacity, the fuel/air ratio is very low through the pulverizer in the case of a direct fired system. However, in accord with the teachings of the present invention a direct fired system is provided with which it is possible to maintain a high fuel to air ratio insofar as the pulverizer is concerned, i.e., as necessitated thereby when fuels of poor grindability are being pulverized therewith, while still maintaining the advantageous features of a direct fired system.

To summarize, in accordance with the present invention there has been provided a new and improved form of firing system of the type that is operative for purposes of effecting the pulverization of solid fuels followed by the firing thereof. Moreover, the subject firing system of the present invention is in the nature of a direct fired system. In addition, in accord with the present invention a direct fired system is provided which possesses the advantages of a direct fired system insofar as simplicity, low cost and safety are concerned. Further, the subject direct fired system of the present invention is also advantageously characterized by the fact that in accord with the mode of operation thereof a more desirable fuel/air ratio is established at the burner. Additionally, in accord with the present invention a direct fired system is provided wherein the establishment of a more desirable fuel/air ratio at the burner is accomplished as a consequence of causing the recirculation back to the pulverizer of a portion of the gases that flow through the classifier.

While several embodiments of my invention have been shown, it will be appreciated that modifications thereof, some of which have been alluded to hereinabove, may still be readily made thereto by those skilled in the art. I, therefore, intend by the appended claims to cover the modifications alluded to herein as well as all other modifications, which fall within the true spirit and scope of my invention.

What is claimed is:

1. In a direct fired system operative for purposes of effecting the pulverization and subsequent firing of solid fuels, said direct fired system including pulverizer means for pulverizing solid fuel material, classifier means for rejecting pulverized solid fuel particles that exceed preset specifications for fineness and for returning the rejected oversize particles to the pulverizer means for further pulverization, burner means for firing therewithin properly sized solid fuel particles, and means establishing a fluid flow path for a stream of hot gases and for the pulverized solid fuel particles from the pulverizer means to the classifier means and from the classifier means to the burner means, the improvement comprising classifier means consisting of a classifying elbow, said classifying elbow including a section of duct having a first bifurcation and a second bifurcation, said first bifurcation being connected to the pulverizer means for recirculating the oversize solid fuel particles back to the pulverizer means for further pulverization therewithin along with a recirculation to the pulverizer means of a portion of stream of hot gases that enters said classifying elbow, said second bifurcation being connected to the burner means for conveying thereto those solid fuel particles that satisfy the preset specifications for fineness along with the remainder of stream of hot gases that enters said classifying elbow, and said classifying elbow further including deflector blade means mounted for movement relative to said section of duct, said deflector blade means being operative to effect the separation of the solid fuel particles received in said classifying elbow into those solid fuel particles that satisfy the preset specifications for fineness and those solid fuel particles that exceed the preset specifications for fineness.

2. In a direct fired system as set forth in claim 1 wherein said deflector blade means of said classifying elbow includes a deflector blade mounted for movement within said section of duct in the path of flow of the solid fuel particles through said classifying elbow.

3. In a direct fired system as set forth in claim 2 wherein said deflector blade is operative to move to and fro in a first plane within said section of duct.

4. In a direct fired system as set forth in claim 3 wherein said deflector blade is operative to move to and fro in a second plane within said section of duct.

5. In a direct fired system as set forth in claim 4 wherein said improvement further comprises a first fan mounted in interposed relation between said classifying elbow and the pulverizer means, said first fan being operative both to effect the recirculation of said portion of stream of hot gases from said classifying elbow to the pulverizer means and to effect the recirculation of the oversize solid fuel particles from said classifying elbow to the pulverizer means.

6. In a direct fired system as set forth in claim 5 wherein said improvement further comprises a second fan mounted in interposed relation between said classifying elbow and the burner means, said second fan being operative to effect the conveyance from said classifying elbow to the burner means of those solid fuel particles that satisfy the preset specifications for fineness and to effect the conveyance of said remainder of stream of hot gases from said classifying elbow to the burner means.

* * * * *